US011555593B2

(12) United States Patent
Schadenhofer et al.

(10) Patent No.: US 11,555,593 B2
(45) Date of Patent: Jan. 17, 2023

(54) MOTOR VEHICLE LIGHT MODULE

(71) Applicant: ZKW Group GmbH, Wieselburg (AT)

(72) Inventors: Peter Schadenhofer, Roggendorf (AT); Alexander Hacker, Wilhelmsburg (AT); Josef Gürtl, Kilb (AT); Bernhard Mandl, Ober-Grafendorf (AT); Christian Jackl, Wieselburg (AT); Anke Müller, Krummnussbaum (AT); Siegmar Hackl, St. Georgen an der Gusen (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/283,304

(22) PCT Filed: Sep. 17, 2019

(86) PCT No.: PCT/EP2019/074761
§ 371 (c)(1),
(2) Date: Apr. 7, 2021

(87) PCT Pub. No.: WO2020/074218
PCT Pub. Date: Apr. 16, 2020

(65) Prior Publication Data

US 2021/0388964 A1 Dec. 16, 2021

(30) Foreign Application Priority Data

Oct. 9, 2018 (EP) ..... 18199281

(51) Int. Cl.
*F21S 43/50* (2018.01)
*F21S 43/14* (2018.01)
(Continued)

(52) U.S. Cl.
CPC ..... *F21S 43/50* (2018.01); *F21S 43/14* (2018.01); *F21S 43/26* (2018.01); *F21W 2103/60* (2018.01)

(58) Field of Classification Search
CPC ..... F21W 2103/60; F21W 2103/55
See application file for complete search history.

(56) References Cited

U.S. PATENT DOCUMENTS 4,670,818 A * 6/1987 Moebius ..... B60Q 1/0466 362/509
2015/0062446 A1 3/2015 Schreiber et al.
(Continued)

FOREIGN PATENT DOCUMENTS

DE 102015107644 A1 11/2016
DE 102016118790 A1 4/2018
(Continued)

OTHER PUBLICATIONS

International Search Report for PCT/EP2019/074761, dated Dec. 16, 2019. (6 pages).

*Primary Examiner* — Eric T Eide
(74) *Attorney, Agent, or Firm* — Eversheds Sutherland (US) LLP

(57) ABSTRACT

Motor vehicle light module (1) comprising at least one microprojector (2) and at least one at least partially translucent projection screen element (3), the at least one microprojector (2) being configured to create a light distribution (4), the light distribution being projectable in the form of a predefinable luminous pattern (5) onto the at least one at least partially translucent projection screen element (3), wherein, when the motor vehicle light module (1) is in a switched-on state, the predefinable luminous pattern (5) is
(Continued)

visible on a side (30) of the projection screen element (3) facing away from the microprojector (2) and contains optically displayed information.

13 Claims, 3 Drawing Sheets

(51) Int. Cl.
*F21S 43/20* (2018.01)
*F21W 103/60* (2018.01)

(56) References Cited

U.S. PATENT DOCUMENTS

| | | | | |
|---|---|---|---|---|
| 2016/0137122 | A1* | 5/2016 | Oshima | F21S 41/635<br>362/512 |
| 2016/0265733 | A1* | 9/2016 | Bauer | F21S 41/16 |
| 2018/0106450 | A1 | 4/2018 | Kamau et al. | |
| 2018/0186276 | A1* | 7/2018 | Glickman | B60R 19/52 |
| 2018/0328564 | A1* | 11/2018 | Albou | B60Q 1/50 |
| 2019/0011102 | A1* | 1/2019 | Gehb | F21S 41/155 |
| 2019/0072252 | A1* | 3/2019 | Moser | F21S 41/68 |
| 2021/0341123 | A1* | 11/2021 | Mototsuji | F21S 41/322 |

FOREIGN PATENT DOCUMENTS

| | | | |
|---|---|---|---|
| EP | 2503222 | A1 | 9/2012 |
| FR | 3034728 | A1 | 10/2016 |

* cited by examiner

MOTOR VEHICLE LIGHT MODULE

The invention relates to a motor vehicle light module comprising at least one microprojector and at least one at least partially translucent projection screen element, the at least one microprojector being configured to create a light distribution, the light distribution being projectable in the form of a predefinable luminous pattern onto the at least one at least partially translucent projection screen element.

The invention also relates to a motor vehicle headlight or a motor vehicle having at least one such motor vehicle light module.

The motor vehicle light modules of the aforementioned type are known in the prior art. Such motor vehicle light modules are often used in (visual) communication systems or as a design light for projecting, for example, corresponding signs onto the road surface in the immediate surroundings of a motor vehicle in which they are installed.

The object of the present invention consists in providing a motor vehicle light module with which luminous motor vehicle branding is possible and which can be used as a communication element (with the analogue environment).

The object is achieved according to the invention in that, when the motor vehicle light module is in a switched-on state, the predefinable luminous pattern is visible on a side of the projection screen element facing away from the microprojector and contains optically displayed information.

The information can be displayed in the form of a sign, a logo, a legend or similar.

The at least one projection screen element can therefore at least partially scatter and at least partially absorb light forming the light distribution, as a result of which the predefinable luminous pattern becomes outwardly visible, as seen from the motor vehicle light module.

The motor vehicle light module according to the invention makes it possible, for example, to enhance luminous design branding considerably, since a luminous legend is much more visible at night, for example.

The motor vehicle light modules according to the invention can also be used for communication elements (with the analogue world) in the field of autonomous driving.

It can be expedient if the microprojector has at least one light source designed to generate light and a projection device, the projection device being arranged downstream of the at least one light source in the radiation direction and being designed to shape the light distribution and project it onto the at least one at least partially translucent projection screen element.

It can be provided for the projection device to have at least one projection lens and at least one aperture, the at least one aperture being positioned in a focal plane of the at least one projection lens and having aperture edges, said aperture edges having a shape corresponding to the predefinable luminous pattern. This means that the shape of the luminous pattern to be emitted can be predefined by shaping the aperture edges of the aperture. Preferably, the aperture is positioned in a plane transverse to the optical axis of the microprojector (see drawings). In this case, the aperture can lie entirely within the focal plane instead of only intersecting it.

It can advantageously be provided for the aperture edges to form at least one symbol, which is information to be displayed, said symbol preferably lying completely within the focal plane.

In a preferred embodiment, it can advantageously be provided for the projection device to have a plurality of projection lenses arranged in a matrix-like manner in an array—projection lens array—and a plurality of apertures arranged in a matrix-like manner in an array—aperture array, each projection lens being assigned a, preferably exactly one, aperture, the aperture edges of different apertures being the same or different. Multiple identical or different luminous patterns can be created thereby. For example, letters of an alphabet, logos, such as motor vehicle branding, hazard symbols and much more can be realised using multiple apertures.

In a tried and tested embodiment, it can be provided for both the projection lens array and the aperture array to be in one piece. The projection lens array can be an optical body consisting of a material such as plastic. The optical body can also be a composite of a glass sheet and a silicone lens array adhering to the glass sheet. The projection lens array and/or the aperture array preferably extend(s) in a plane transverse to the optical axis.

It can advantageously be provided for the at least one projection lens to have a lens diameter between 1 and 5 mm, preferably 2 mm, and to consist preferably at least partially of glass or silicone, and/or for the projection screen element to be spaced from the at least one projection lens by approximately 1 cm to approximately 10 cm. This results in a very compact motor vehicle light module, which makes the installation thereof in the main headlight and/or in the front of the vehicle much simpler. The use of materials such as glass or polymers, for example plastic or silicone, for producing the projection lenses makes the motor vehicle light modules more cost-effective.

Owing to a small distance between the at least one projection lens of the respective microprojector and the projection screen element positioned in front of said microprojector, the light intensity on the projection screen element is sufficient to make the luminous pattern visible. However, the luminous pattern is hardly measurable any longer at a distance of 10-25 m from a white wall (measurement screen in a lighting technology laboratory), which means that problems with approval (maximum scattered light values) are not to be expected. Powerful light sources are likewise not necessary. If, as described below, low-energy LED light sources are used, they do not need any heat sinks provided to cool these LED light sources.

In a preferred variant, it can advantageously be provided for the at least one light source to be a semiconductor-based light source, for example an LED light source. In the case of multiple light sources, they can radiate light of different colours. This can attract the attention of pedestrians or other road users much more effectively.

It can be expedient if the microprojector additionally comprises a collimator positioned between the at least one light source and the projection device. A more uniform illumination of the aperture(s) can thus be ensured, for example.

With regard to better visibility of the luminous pattern, it can be advantageous if the at least one projection screen element is a transparent layer with a pebbled face, or a frosted plastic or glass sheet, or a clear plastic sheet or a clear glass sheet containing scattering particles.

The scattering particles are not normally visible to the human eye in transparent or clear materials such as plastic or glass.

The frosted plastic sheet can consist for example of opaque plastic. The frosted plastic sheet can however also be obtained by a specific coating of a surface of a (transparent) plastic sheet or by adhesively bonding a suitable film to a surface of a transparent plastic sheet. Preferably, frosted plastic sheets having a translucency of approximately 20% to approximately 70% are used.

In a plastic sheet containing the scattering particles, the scattering particles act such that the light input into the plastic sheet is ideally output forwards uniformly over the area. For example, a sheet manufactured by Evonik appears transparent, but when light from a light source, such as an LED light source or a microprojector, passes into it, said light is scattered by the particles, as already mentioned.

The object is also achieved by a motor vehicle headlight having at least one aforementioned motor vehicle light module.

To achieve better motor vehicle branding, it can advantageously be provided for the at least one microprojector to be positioned in a (rear) region of a motor vehicle headlight and for the at least one projection screen element to be designed as a region of a motor vehicle headlight cover, for example.

The object is also achieved by a motor vehicle having at least one aforementioned motor vehicle light module.

With regard to the communication with the analogue environment, it can advantageously be provided for the at least one projection screen element to be positioned on a front of the motor vehicle, preferably formed in a region of a radiator grille of the motor vehicle.

The "region of a radiator grille" means a region in which the radiator grille is positioned in conventional motor vehicles. Since, however, the radiator grille in the usual form no longer exists in modern electric vehicles, for example, "region of a radiator grille" means a region on the front of the motor vehicle in which the radiator grille would be positioned.

It is likewise conceivable for the projection screen element and the motor vehicle light module to be attached in other regions of a motor vehicle, such as in the side doors or on the tail.

A further advantage of the present invention consists in that the at least one microprojector is not visible from the outside and is also protected from environmental influences (stone chips, solar radiation, chemicals etc.) by the downstream projection screen element.

In the context of the present invention, terms such as "partially transparent projection screen element", "partially translucent projection screen element" or similar mean a projection screen element which has light-scattering elements and partially lets through, partially scatters (in all directions) and partially absorbs the light incident on the projection screen element. The amount of scattered light is sufficient for a light distribution projected onto the projection screen element to be visible (with the naked eye in daylight and at night) on both sides of the projection screen element. The light-scattering elements mean that the image projected onto the projection screen element by means of the microprojector is visible both on a side of the projection screen element facing the microprojector and on a side of the projection screen element facing away from the microprojector. The partially transparent projection screen element can for example be a frosted plastic sheet, a transparent sheet with a pebbled surface, or a plastic sheet containing scattering particles (e.g. manufactured by Evonik).

The invention, including further advantages, is explained in more detail below using exemplary embodiments, which are illustrated in the drawing. In the drawing, FIG. 1 shows an exploded diagram of a light module;

Figure 1:
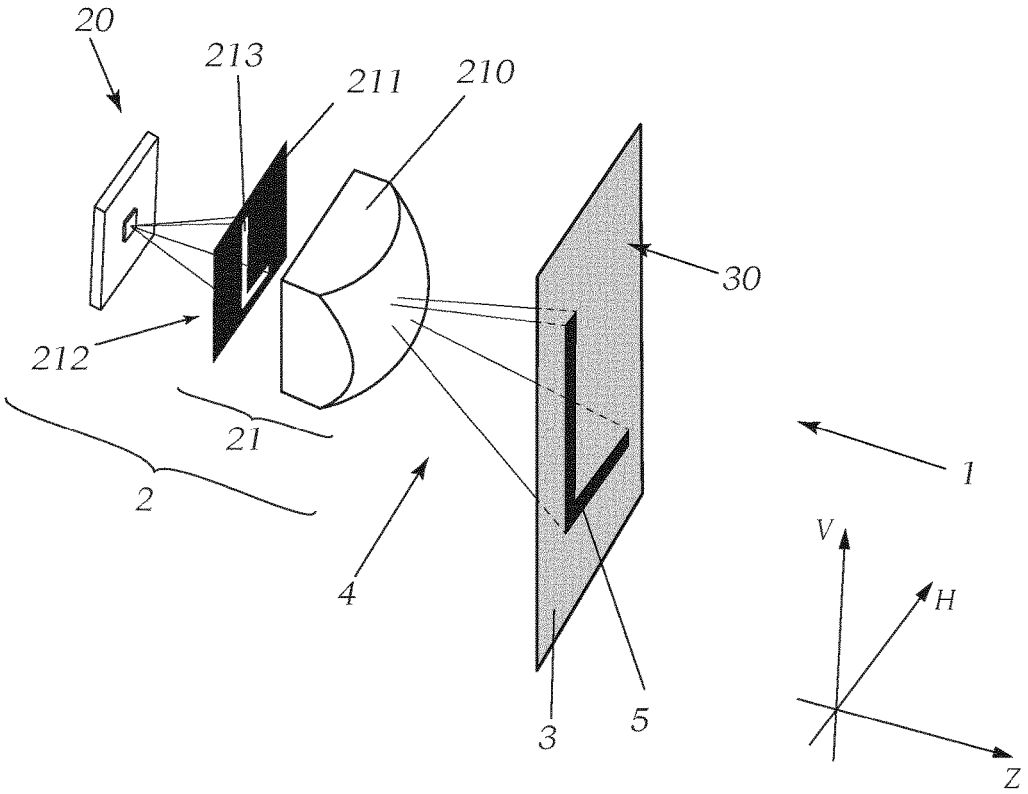

Reference is first made to FIG. 1. It shows a light module 1, which can correspond to the motor vehicle light module according to the invention. The light module 1 has a microprojector 2 and an at least partially translucent projection screen element 3. The microprojector 2 is configured to create a predefinable light distribution 4, which is projected in the form of a predefinable luminous pattern 5 onto the at least partially translucent projection screen element 3 when the microprojector 2 is switched on. Because the projection screen element 3 is partially translucent, light forming the light distribution 4 is at least partially scattered at the projection screen element 3. As a result, the predefinable luminous pattern 5 becomes visible on a side 30 of the projection wall element 3 facing away from the microprojector 2 when the light module 1 is put into operation. The side 30 of the projection screen element 3 facing away from the microprojector 2 is preferably a side of the projection screen element 3 opposite the side facing the microprojector 2. The microprojector 2 is designed such that the predefinable luminous pattern 5 contains optically displayed information. This means that the light distribution 4 created by the microprojector 2 carries information which is displayed by projection onto the projection screen element 3. The visibility of the luminous pattern 5 on the side 30 facing away from the microprojector 2 has the advantage that, for example, a predefined message can be sent thereby into the surroundings of the light module 1. To receive this message, it is no longer necessary to be between the microprojector 2 and the projection screen element 3, since the message is sent by means of light which passes through the projection screen element 3 and is scattered in the radiation direction Z of the microprojector 2. The projection screen element 3 can be arranged transversely to the optical axis of the light module 1, as can be seen in FIGS. 1 to 5. However, it is also quite conceivable for the projection screen element to be arranged inclined relative to the optical axis, for example to take into account vehicle contours.

The at least one projection screen element 3 can for example be designed as a transparent layer having a pebbled face or, as already mentioned, a frosted plastic sheet, or a plastic sheet containing scattering particles. As mentioned above, the projection screen element 3 should be at least partially translucent so that it can scatter at least some of the incident light forwards (for example in radiation direction Z). For example, a rough surface can be provided for projection screen elements consisting of clear materials. The roughness depth can be in the micrometre range and be for example approximately 5 to 40 micrometres, preferably 10 to 30 micrometres, in particular 20 μm. Furthermore, the projection screen element 3 can be in the form of a sheet manufactured by Evonik, which consists of glass or polymers, and have a smooth surface. As already mentioned, the projection screen element 3 can be a frosted sheet or a sheet containing scattering particles.

The microprojector 2 can have one or more light sources 20. FIGS. 1 to 5 show LED light sources. The light source can for example also be another, for example semiconductor-based light source, such as a laser light source. Furthermore, the microprojector 2 has a projection device 21, which is positioned downstream of the light source(s) (20) in the radiation direction Z and is designed to shape the light distribution 4 and to project it onto the at least one at least partially translucent projection screen element 3.

The light sources 20 can be arranged in a matrix-like manner in an array. The LED light sources can be arranged on a common (FIG. 4) or on separate (FIG. 5) printed circuit boards, which are substantially perpendicular to the radiation direction Z.

At this point it should be noted that the projection screen element 3 is preferably arranged substantially perpendicular to the radiation direction Z. However, it is also quite conceivable to position the projection screen element 3 inclined to the radiation direction Z and thus to create luminous patterns 5 on obliquely arranged faces (projection screen elements). Furthermore, it is conceivable for the projection screen element 3 to have regions in different colours. It is also possible to design the projection screen element 3 in a predefined colour. The number of design options is thus increased even more.

Figure 4:
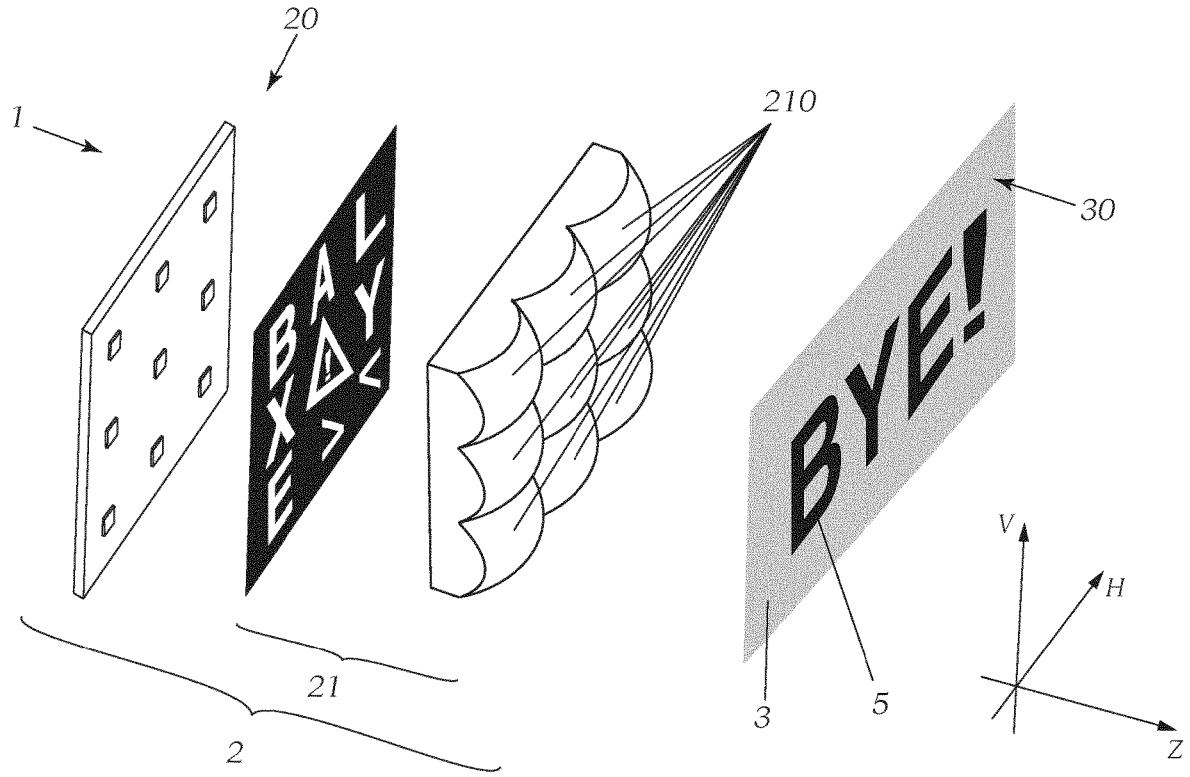
FIG. 4 shows an exploded diagram of a light module having a microprojector with multiple LED light sources and multiple projection lenses.
Figure 5:
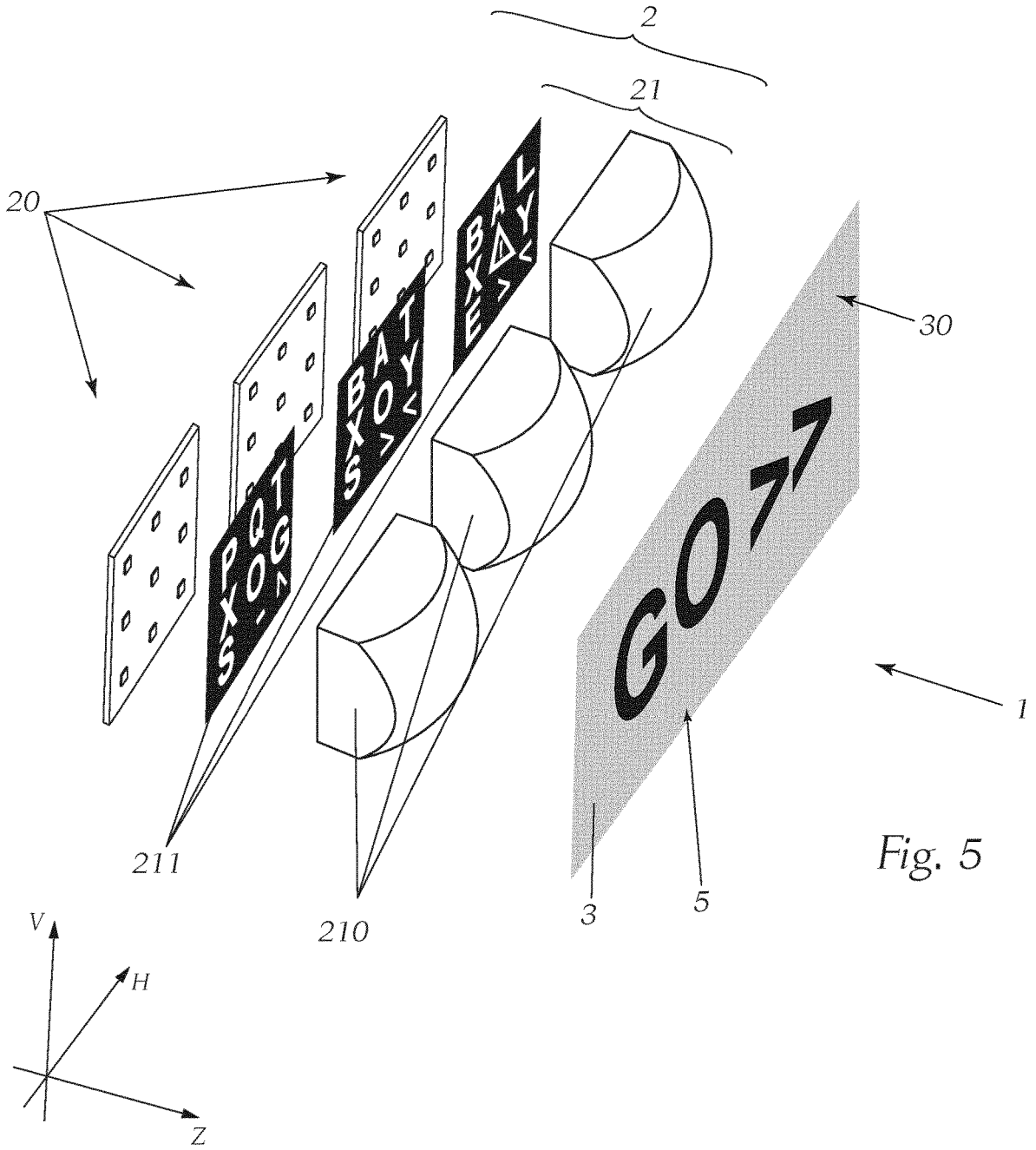
FIG. 5 shows an exploded diagram of a light module having multiple microprojectors with multiple LED light sources.

The projection device 21 can have one or more projection lenses 210 and one or more apertures 211 assigned to the projection lenses 210. Each projection lens 21 can for example be plano-convex or plano-concave or else a free-form lens. Preferably, each aperture 211 is assigned at least one projection lens 210. Both the projection lenses 210 and the apertures 211 can be arranged in a matrix-like manner, preferably in a plane substantially perpendicular to the radiation direction Z. Furthermore, all the projection lenses 210 and apertures 211 can in each case form a single (FIG. 4) or multiple separate (FIG. 5) monolithic structures. The aperture(s) 211 is/are arranged, preferably completely, within a focal plane of the respective projection lens(es) 210. Furthermore, each aperture 211 has aperture edges 212, which have a shape corresponding to the predefinable luminous pattern 5. The aperture edges 212 of each aperture 211 can form a pattern which is congruent with the entire predefinable luminous pattern 5 (FIGS. 1 to 3) or with only parts thereof (FIGS. 4 and 5). The luminous pattern 5 produced on the projection screen element 3 can therefore be predefined by the shape and profile of the aperture edges 212 of the at least one aperture 212. However, the luminous pattern can also be created by laser on a light conversion element, when the light source(s) is/are laser light source(s) (not shown).

The aperture edges 212 of each aperture 211 can therefore form a symbol or a part of the symbol which makes up the information to be displayed. The apertures 211 can for example be in the form of metal platelets having holes of corresponding shape or be printed on one side of a glass or plastic substrate by means of a lithographic method. Projection lenses 210, for example consisting of silicone, can be attached on the opposite side of the glass or plastic substrate. In this case, the glass or plastic substrate acts as a carrier for projection lenses 210; in this case one refers to a composite lens. It is also conceivable for the apertures 211 to be obtained by applying a suitable photoresist or by means of metallisation and lasering out.

As can be seen in FIGS. 1 to 5, the symbols can be completely different: letters, logos (by means of which a luminous motor vehicle manufacturer branding is possible, for example), signs such as warning signs, and so on.

The projection lenses 210 in the light modules shown in FIGS. 1 to 5 have a lens diameter between 1 and 5 mm, preferably 2 mm, and can consist at least partially of silicone. The projection lenses 210 can also contain epoxy resins, acrylates or other plastics or be formed from these materials. The projection screen element 3 can be spaced from the projection lens(es) by approximately 1 cm to approximately 10 cm.

Figure 2:
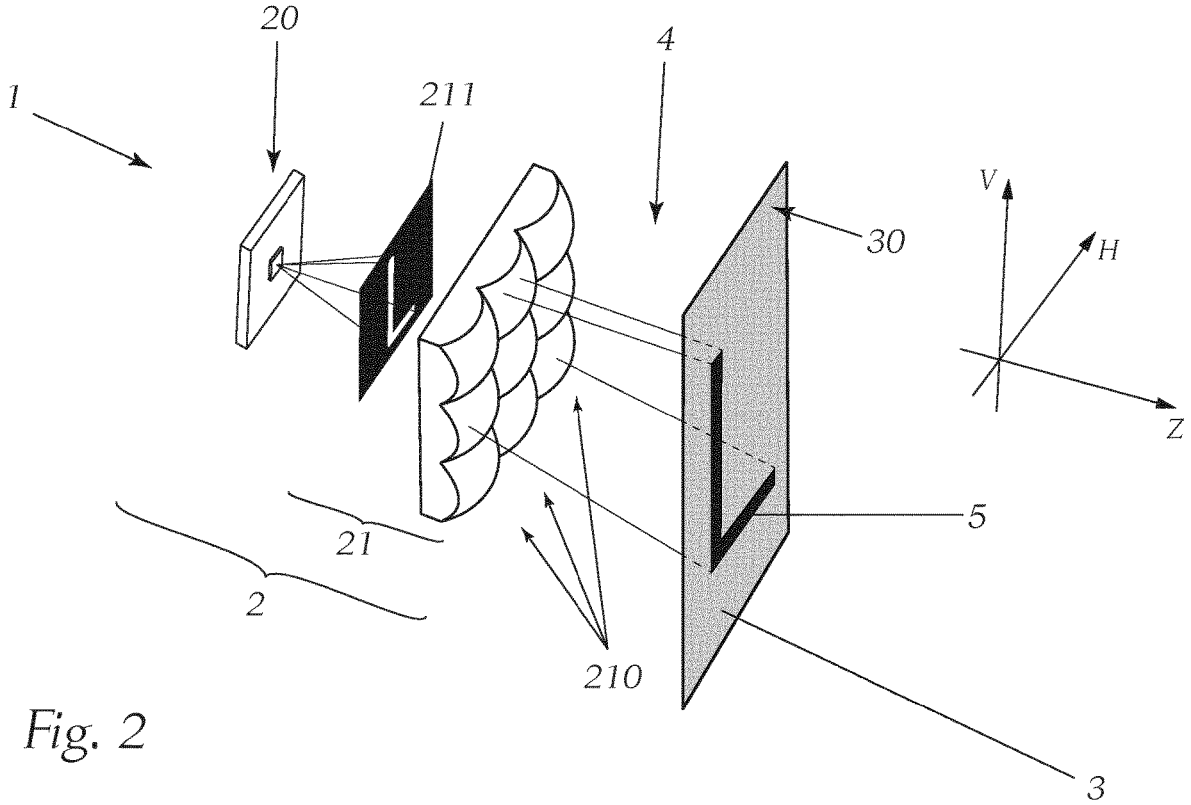
FIG. 2 shows an exploded diagram of a light module having a microprojector with multiple projection lenses.

FIG. 2 shows an embodiment of the light module 1 in which multiple projection lenses 210 (a 3×3 array is shown) are arranged downstream of the aperture 211. It is thereby possible to set the light intensity within the predefinable luminous pattern 5 better or make the luminous pattern 5 brighter. Such a configuration is of course possible in the light modules in FIGS. 1 and 3 to 5.

In the embodiment shown in FIG. 2, it can be expedient for the projection screen element 3 to be arranged in the image focal plane of the projection device 21.

In the embodiments shown in FIGS. 1 and 3 to 5, it can be expedient if the image focal plane of the projection device 21 is at infinity. In this case, the projection screen element 3 is arranged downstream of the projection device 21 in the radiation direction Z at a defined distance, for example of approximately 10 mm to approximately 100 mm, preferably of approximately 25 mm to 50 mm, and thus creates the luminous pattern 5 visible on both sides of the projection screen element 3.

The light intensity of the luminous pattern 5 can vary depending on the power of the light source, such as LED light source, and the distance between the microprojector 2 and the projection screen element 3.

Figure 3:
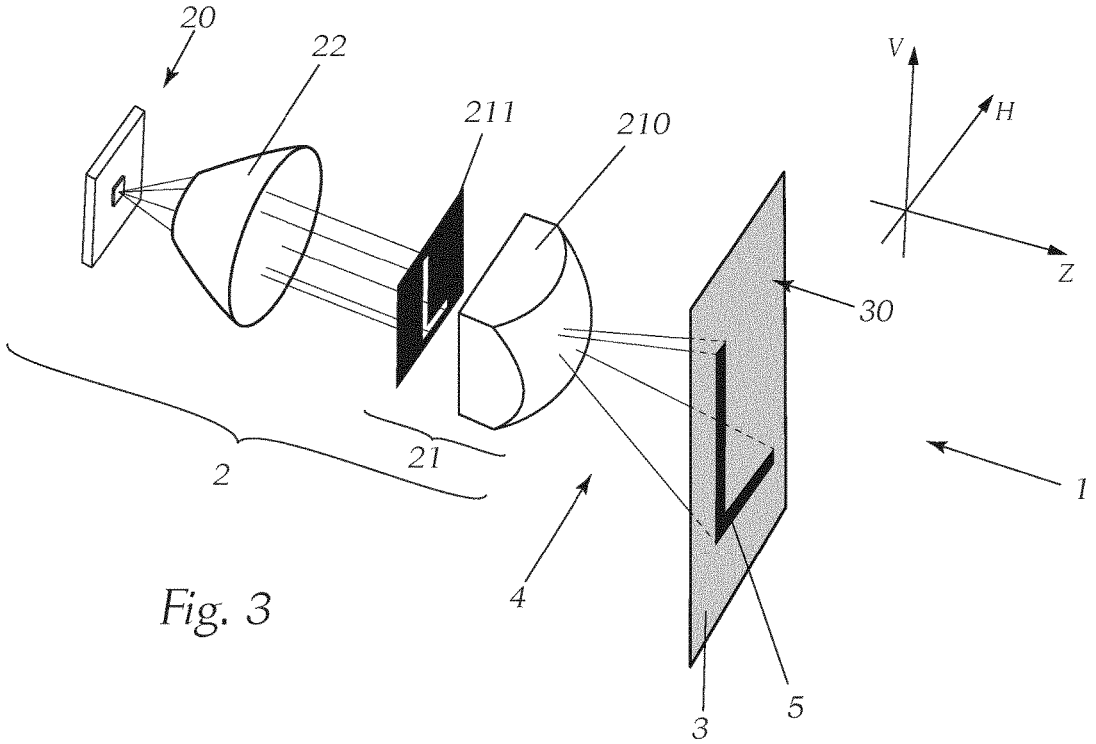
FIG. 3 shows an exploded diagram of a light module having a microprojector with a collimator.

It can be seen in FIG. 3 that the microprojector 2 can additionally comprise a collimator 22 arranged between the light source 20 and the projection device 21. A collimator can likewise be provided in the microprojectors shown in FIGS. 1, 2 and 4, 5 and arranged downstream of the corresponding light source.

FIG. 4 shows an example having multiple LED light sources 20, apertures 211 and projection lenses 210, each LED light source 20 being assigned exactly one aperture and exactly one projection lens 210. Such a system can in theory be assembled to form a partial microprojector. If the LED light sources 20 are controllable separately from one another, the aforementioned message can be a whole word, a number, a whole sentence or a legend. The individual letters of the word can appear on the projection screen element 3 either all together or in a predefined chronological sequence.

FIG. 5 shows a light module 1 which has multiple microprojectors 2. Each microprojector 2 can be controlled independently of the other microprojectors 2. Furthermore, each microprojector 2 has multiple LED light sources 20 and multiple apertures 211 with different symbols. If the microprojectors 2 are controlled in coordination with one another, the number of possible different luminous patterns 5 and thus the numbers of the messages to be sent is considerably increased. It can also be seen in FIG. 5 that the whole message does not have to be generated by the same microprojector 2: one microprojector projects the symbol "G", another projects the symbols "○" and ">", and a third projects the symbol ">" onto the—in this case common—projection screen element 3.

The light module 1 of FIG. 5 can be improved by each projection lens 210 being designed as a lens array. It is particularly advantageous if exactly one LED corresponds to each lens in the lens array. A particularly sharp image can be produced thereby, since distortions in the edge region of the projection lens 210 are reduced. For example, the projection lens can be designed as a 3×3 lens array—similar to the arrangement of the projection lenses 210 in FIG. 4—and thus correspond to the arrangement of the individual LEDs on the printed circuit board, which likewise form a 3×3 array.

FIGS. 4 and 5 thus show examples of the motor vehicle light module according to the invention, with which whole legends can be realised by switching the individual microprojectors 2 and/or the individual light sources 20 on and off.

Furthermore, it is illustrated in FIGS. 4 and 5 that multiple motor vehicle light modules can be used as building blocks for an overall light module. A modular construction is thus possible, in which different motor vehicle light modules can have differently designed beam apertures 211.

In the case of multiple microprojectors 2 and/or light sources 20 or arrays of LED light sources, these can be arranged next to one another.

The above-described light modules can for example be used for design innovations in the main headlight region (luminous logos, legends etc.) but also as communication elements (with the analogue environment), for example in the field of automated or autonomous driving.

The reference numbers in the claims are used merely for better understanding of the present inventions and do not mean a limitation of the present inventions.

Unless stated otherwise in the description of the aforementioned embodiments, it is assumed that the described embodiments can be combined with one another as desired. This means, inter alia, that the technical features of one embodiment can also be combined with the technical features of another embodiment individually and independently of one another as desired to arrive in this manner at a further embodiment of the same invention.

The invention claimed is:

1. A motor vehicle light module (1) comprising:

at least one microprojector (2); and at least one at least partially translucent projection screen element (3), wherein the at least one microprojector (2) is configured to create a light distribution (4), the light distribution being projectable in the form of a predefinable luminous pattern (5) onto the at least one at least partially translucent projection screen element (3), wherein, when the motor vehicle light module (1) is in a switched-on state, the predefinable luminous pattern (5) is visible on a side (30) of the projection screen element (3) facing away from the microprojector (2) and contains optically displayed information, wherein the at least one microprojector (2) comprises at least one light source (20) configured to generate light and a projection device (21), the projection device (21) being arranged downstream of the at least one light source (20) in the radiation direction (Z) and being designed to shape the light distribution (4) and project it onto the at least one at least partially translucent projection screen element (3), wherein the projection device (21) comprises at least one projection lens (210) and at least one aperture (211), the at least one aperture (211) being positioned in a focal plane of the at least one projection lens (210) and having aperture edges (212), wherein the aperture edges (212) have a shape corresponding to the predefinable luminous pattern (5) and form at least one symbol (213) which is information to be displayed, wherein the projection device (21) has a plurality of projection lenses (210) arranged in a matrix-like manner in an array and a plurality of apertures (211) arranged in a matrix-like manner in an array, wherein each one of the projection lenses (210) is assigned to one of the plurality of apertures (211), the aperture edges (212) of different apertures (211) being the same or different, and wherein each light source is assigned exactly one aperture and exactly one projection lens and the light sources are controllable separately from one another.

2. The motor vehicle light module according to claim 1, wherein the at least one projection lens (210) has a lens diameter between 1 and 5 mm and consists at least partially of glass or polymer, and/or the projection screen element (3) is spaced from the at least one projection lens (210) by approximately 1 cm to approximately 10 cm.

3. The motor vehicle light module according to claim 1, wherein the at least one light source (20) is a semiconductor-based light source.

4. The motor vehicle light module according to claim 1, wherein the at least one microprojector (2) additionally comprises a collimator (22) arranged between the at least one light source (20) and the projection device (21).

5. The motor vehicle light module according to claim 1, wherein the at least one projection screen element (3) is a transparent layer with a pebbled face, or a frosted plastic or glass sheet, or a clear plastic or glass sheet containing scattering particles.

6. A motor vehicle headlight having at least one motor vehicle light module (1) according to claim 1.

7. The motor vehicle headlight according to claim 6, wherein the at least one microprojector (2) is arranged in a region of a motor vehicle headlight, and the at least one projection screen element (3) is configured as a region of a motor vehicle headlight cover.

8. A motor vehicle having at least one motor vehicle light module according to claim 1.

9. The motor vehicle according to claim 8, wherein the at least one projection screen element (3) is arranged on the front of the motor vehicle formed in a region of a radiator grille of the motor vehicle.

10. The motor vehicle light module according to claim 1, wherein each one of the projection lenses (210) is assigned to exactly one of the plurality of apertures (211).

11. The motor vehicle light module according to claim 2, wherein the lens diameter of the at least one projection lens is 2 mm.

12. The motor vehicle light module according to claim 2, wherein the at least one projection lens consists at least partially of plastic or silicone.

13. The motor vehicle light module according to claim 3, wherein the semiconductor-based light source is an LED light source.

* * * * *